US010895168B2

(12) United States Patent
Xu

(10) Patent No.: US 10,895,168 B2
(45) Date of Patent: Jan. 19, 2021

(54) TURBINE BLADE WITH SERPENTINE CHANNELS

(71) Applicant: Solar Turbines Incorporated, San Diego, CA (US)

(72) Inventor: Hongzhou Xu, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 49 days.

(21) Appl. No.: 16/427,144

(22) Filed: May 30, 2019

(65) Prior Publication Data

US 2020/0378263 A1 Dec. 3, 2020

(51) Int. Cl.
*F01D 5/18* (2006.01)
*F01D 25/12* (2006.01)

(52) U.S. Cl.
CPC ..... *F01D 25/12* (2013.01); *F01D 5/186* (2013.01); *F01D 5/187* (2013.01); *F05B 2250/70* (2013.01); *F05D 2230/21* (2013.01); *F05D 2240/303* (2013.01); *F05D 2240/304* (2013.01); *F05D 2240/307* (2013.01); *F05D 2250/185* (2013.01); *F05D 2260/22141* (2013.01)

(58) Field of Classification Search
CPC ..... F01D 5/186; F01D 5/187; F01D 25/12; F05D 2230/21; F05D 2240/303; F05D 2240/304; F05D 2240/307; F05D 2250/185; F05D 2250/70; F05D 2260/22141
See application file for complete search history.

(56) References Cited

U.S. PATENT DOCUMENTS

| | | | |
|---|---|---|---|
| 5,813,835 | A | 9/1998 | Corsmeier et al. |
| 7,296,973 | B2 | 11/2007 | Lee et al. |
| 7,780,414 | B1 | 8/2010 | Liang |
| 7,901,183 | B1 | 3/2011 | Liang |
| 8,087,892 | B1 | 1/2012 | Liang |
| 8,192,146 | B2 | 6/2012 | Liang |
| 8,585,365 | B1 | 11/2013 | Liang |
| 8,613,597 | B1 | 12/2013 | Liang |
| 2010/0226789 | A1 | 9/2010 | Liang |
| 2014/0169962 | A1 | 6/2014 | Lee |
| 2015/0040582 | A1 | 2/2015 | Dong et al. |

FOREIGN PATENT DOCUMENTS

| | | |
|---|---|---|
| EP | 1605138 | 12/2005 |
| EP | 1923537 | 5/2008 |
| EP | 3441570 | 2/2019 |
| WO | 2018208370 | 11/2018 |

*Primary Examiner* — Igor Kershteyn
(74) *Attorney, Agent, or Firm* — Procopio, Cory, Hargreaves & Savitch LLP

(57) ABSTRACT

A turbine blade having a base and an airfoil, the base including a root end. The airfoil including a skin extending from the base and defining a leading edge, a trailing edge, having a tip end opposite from the root end. The turbine blade further including dividers located within the airfoil. The dividers, leading edge, trailing edge, and skin define serpentine channels within the airfoil. A first multi-bend heat exchange path and a second multi-bend heat exchange path extend through the serpentine channels to cool portion of the turbine blade.

20 Claims, 5 Drawing Sheets

TURBINE BLADE WITH SERPENTINE CHANNELS

TECHNICAL FIELD

The present disclosure generally pertains to gas turbine engines. More particularly this application is directed toward a turbine blade with serpentine channels.

BACKGROUND

Internally cooled turbine blades may include passages within the blade. These hollow blades may be cast. In casting hollow gas turbine engine blades having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs, and similar features separating and/or residing in cooling passageways in the cast airfoil.

U.S. Pat. No. 8,192,146 to George Liang, describes a turbine blade having an internal cooling system with dual serpentine cooling channels in communication with tip cooling channels. The cooling system may include first and second tip cooling channels in communication with the first and second serpentine cooling channels, respectively. The first tip cooling channel may extend from the leading edge to the trailing edge and be formed from a first suction side tip cooling channel and a first pressure side tip cooling channel. The second tip cooling channel may extend from a midchord region toward the trailing edge and may be positioned between the pressure and suction sides such that the second tip cooling channel is positioned generally between the first suction side and pressure side tip cooling channels. The first and second tip cooling channels may exhaust cooling fluids through the trailing edge.

The present disclosure is directed toward overcoming one or more of the problems discovered by the inventors.

SUMMARY

A turbine blade for a gas turbine engine is disclosed herein. In embodiments the turbine blade includes a base and an airfoil. The base includes a root end, a forward face, an aft face located opposite the forward face, a first inlet located proximate to the forward face, and a second inlet located between the first inlet and aft face. The airfoil includes a skin extending from the base and defining a leading edge, a trailing edge opposite the leading edge, a pressure side, and a suction side opposite the pressure side, and having a tip end opposite from the root end.

The turbine blade further includes a first transition portion extending from adjacent the first inlet towards the leading edge. The turbine blade further includes a first rib portion extending from the first transition portion opposite the root end towards the tip end, and having a first end located opposite from the root end. The turbine blade further includes a third transition portion extending from the leading edge towards the trailing edge, located proximate to the tip end, and located between the first end and the tip end. The turbine blade further includes a third rib portion extending from the third transition portion towards the root end, located between the first rib portion and the trailing edge, the third rib portion located proximate to the first rib portion;

The turbine blade further includes a second transition portion extending from adjacent the second inlet towards the trailing edge. The turbine blade further includes a second rib portion extending from the second transition portion opposite the root end towards the tip end, the second rib portion located between the third rib portion and the trailing edge, the second rib portion having a second end located opposite the root end. The Turbine blade further includes a fourth transition portion extending from the trailing edge towards the leading edge, located between the second end and the tip end. The turbine blade further includes a fourth rib transition portion extending from the fourth transition portion towards the root end, the fourth rib transition portion located between the third rib portion and the trailing edge. The turbine blade further includes a fourth rib portion extending from proximate the fourth transition portion, towards the root end, the fourth rib portion located between the third rib portion and the second rib portion, and the fourth rib portion having a fourth end located opposite from the tip end.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
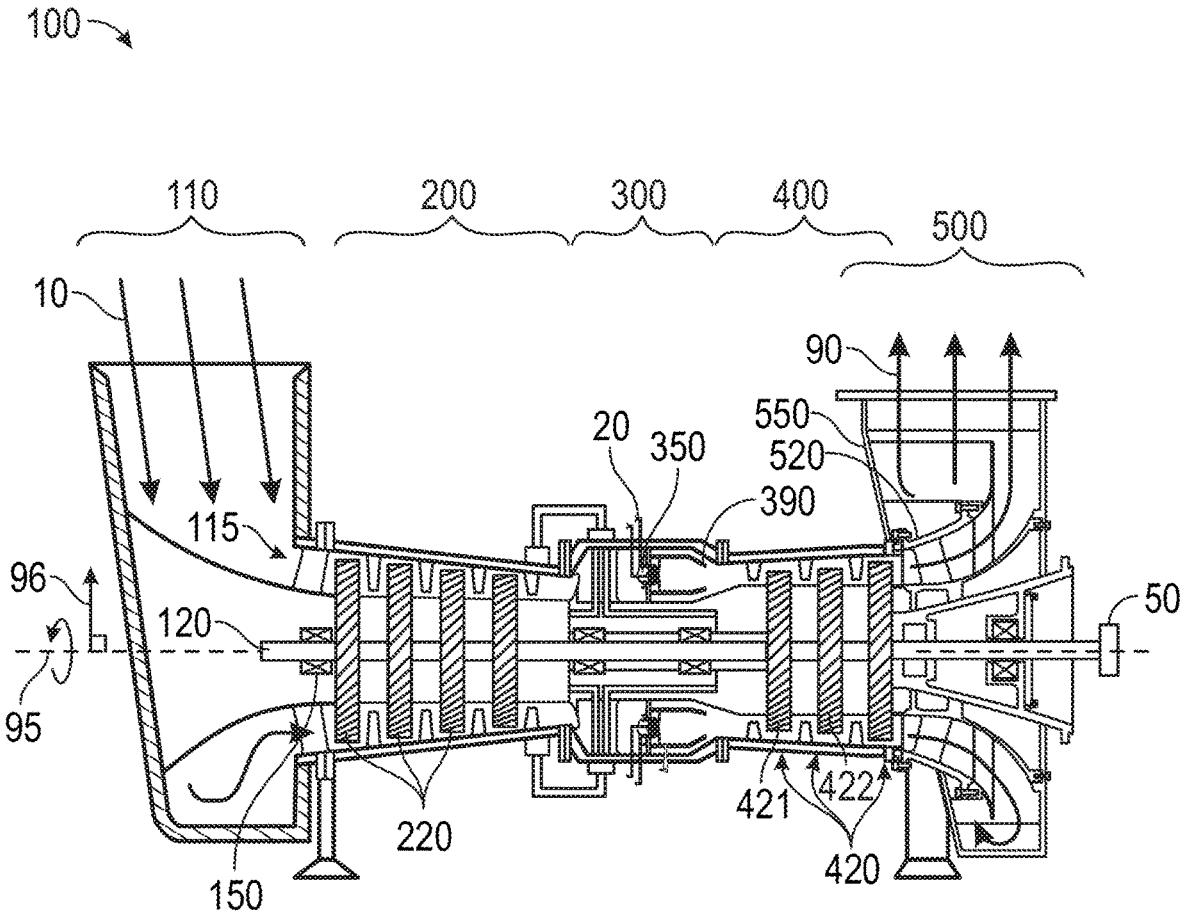
FIG. 1 is a schematic illustration of an exemplary gas turbine engine.

FIG. 1 is a schematic illustration of an exemplary gas turbine engine. Some of the surfaces have been left out or exaggerated for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a gas producer or "compressor" 200, a combustor 300, a turbine 400, an exhaust 500, and a power output coupling 50. The compressor 200 includes one or more compressor rotor assemblies 220. The combustor 300 includes one or more injectors 350 and includes one or more combustion chambers 390. The turbine 400 includes one or more turbine rotor assemblies 420. The exhaust 500 includes an exhaust diffuser 520 and an exhaust collector 550.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") circumferentially distributed in an annular casing.

A gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420 and a second stage rotor assembly 422 is located downstream of the first stage turbine rotor assembly 421. However, other numbering/naming conventions may also be used.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
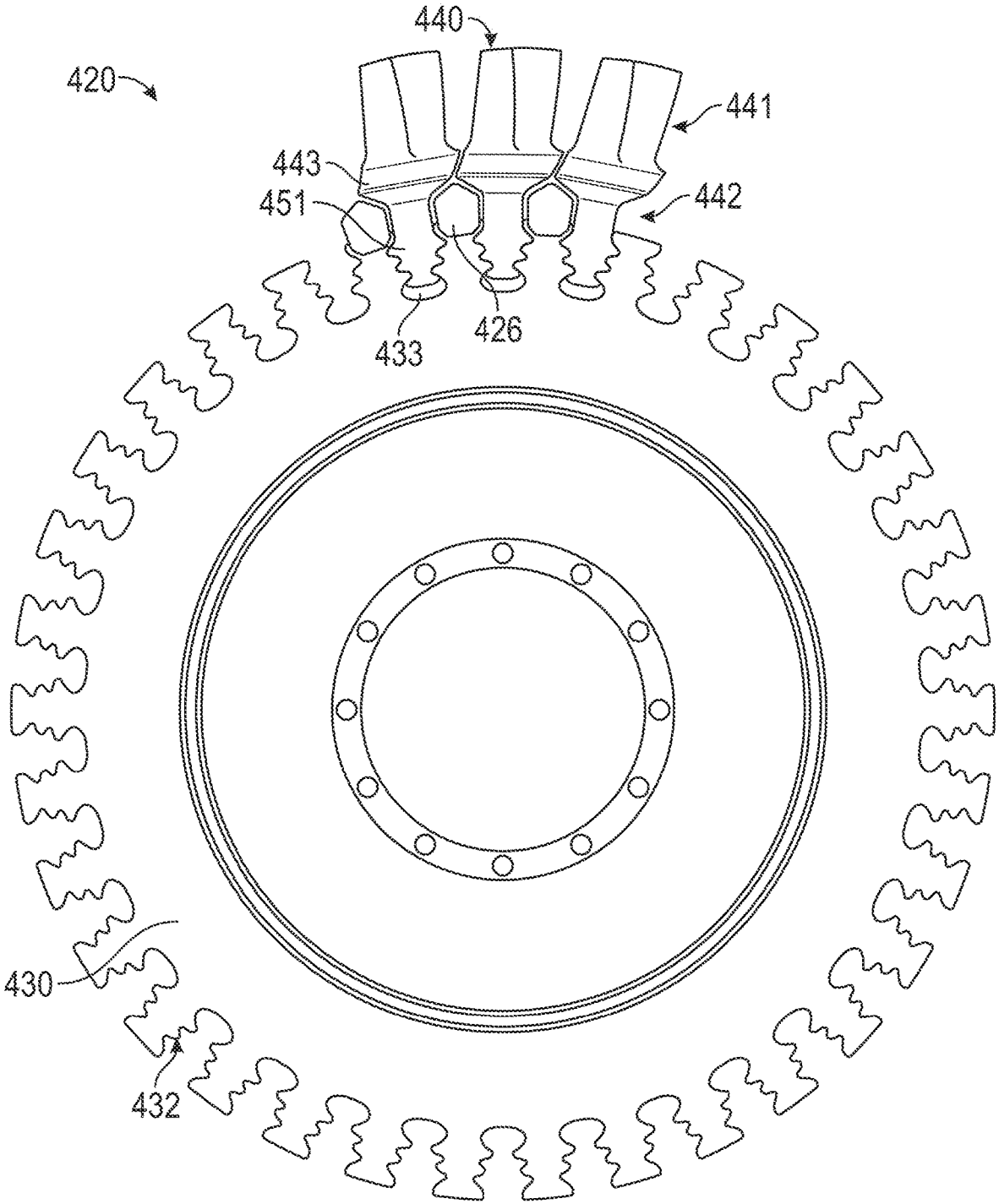
FIG. 2 is an axial view of an exemplary turbine rotor assembly.

FIG. 2 is an axial view of an exemplary turbine rotor assembly. In particular, the turbine rotor assembly 420 schematically illustrated in FIG. 1 is shown here in greater detail, but in isolation from the rest of gas turbine engine 100. The turbine rotor assembly 420 includes a turbine rotor disk 430 that is circumferentially populated with a plurality of turbine blades configured to receive cooling air ("cooled turbine blades" 440*a*) and a plurality of dampers 426. Here, for illustration purposes, turbine rotor disk 430 is shown depopulated of all but three cooled turbine blades 440*a* and three dampers 426.

Each cooled turbine blade 440*a* may include a base 442 including a platform 443 and a blade root 451. For example, the blade root 451 may incorporate "fir tree", "bulb", or "dove tail" roots, to list a few. Correspondingly, the turbine rotor disk 430 may include a plurality of circumferentially distributed slots or "blade attachment grooves" 432 configured to receive and retain each cooled turbine blade 440*a*. In particular, the blade attachment grooves 432 may be configured to mate with the blade root 451, both having a reciprocal shape with each other. In addition the blade attachment grooves 432 may be slideably engaged with the blade attachment grooves 432, for example, in a forward-to-aft direction.

Being proximate the combustor 300 (FIG. 1), the turbine rotor assembly 420 may incorporate active cooling. In particular, compressed cooling air may be internally supplied to each cooled turbine blade 440*a* as well as predetermined portions of the turbine rotor disk 430. For example, here turbine rotor disk 430 engages the cooled turbine blade 440*a* such that a cooling air cavity 433 is formed between the blade attachment grooves 432 and the blade root 451. In other embodiments, other stages of the turbine may incorporate active cooling as well.

When a pair of cooled turbine blades 440*a* is mounted in adjacent blade attachment grooves 432 of turbine rotor disk 430, an under-platform cavity may be formed above the circumferential outer edge of turbine rotor disk 430, between shanks of adjacent blade roots 451, and below their adjacent platforms 443, respectively. As such, each damper 426 may be configured to fit this under-platform cavity. Alternately, where the platforms are flush with circumferential outer edge of turbine rotor disk 430, and/or the under-platform cavity is sufficiently small, the damper 426 may be omitted entirely.

Here, as illustrated, each damper 426 may be configured to constrain received cooling air such that a positive pressure may be created within the under-platform cavity to suppress the ingress of hot gases from the turbine. Additionally, damper 426 may be further configured to regulate the flow of cooling air to components downstream of the turbine rotor assembly 420. For example, damper 426 may include one or more aft plate apertures in its aft face. Certain features of the illustration may be simplified and/or differ from a production part for clarity.

Each damper 426 may be configured to be assembled with the turbine rotor disk 430 during assembly of the turbine rotor assembly 420, for example, by a press fit. In addition, the damper 426 may form at least a partial seal with the adjacent cooled turbine blades 440*a*. Furthermore, one or more axial faces of damper 426 may be sized to provide sufficient clearance to permit each cooled turbine blade 440*a* to slide into the blade attachment grooves 432, past the damper 426 without interference after installation of the damper 426.

Figure 3:
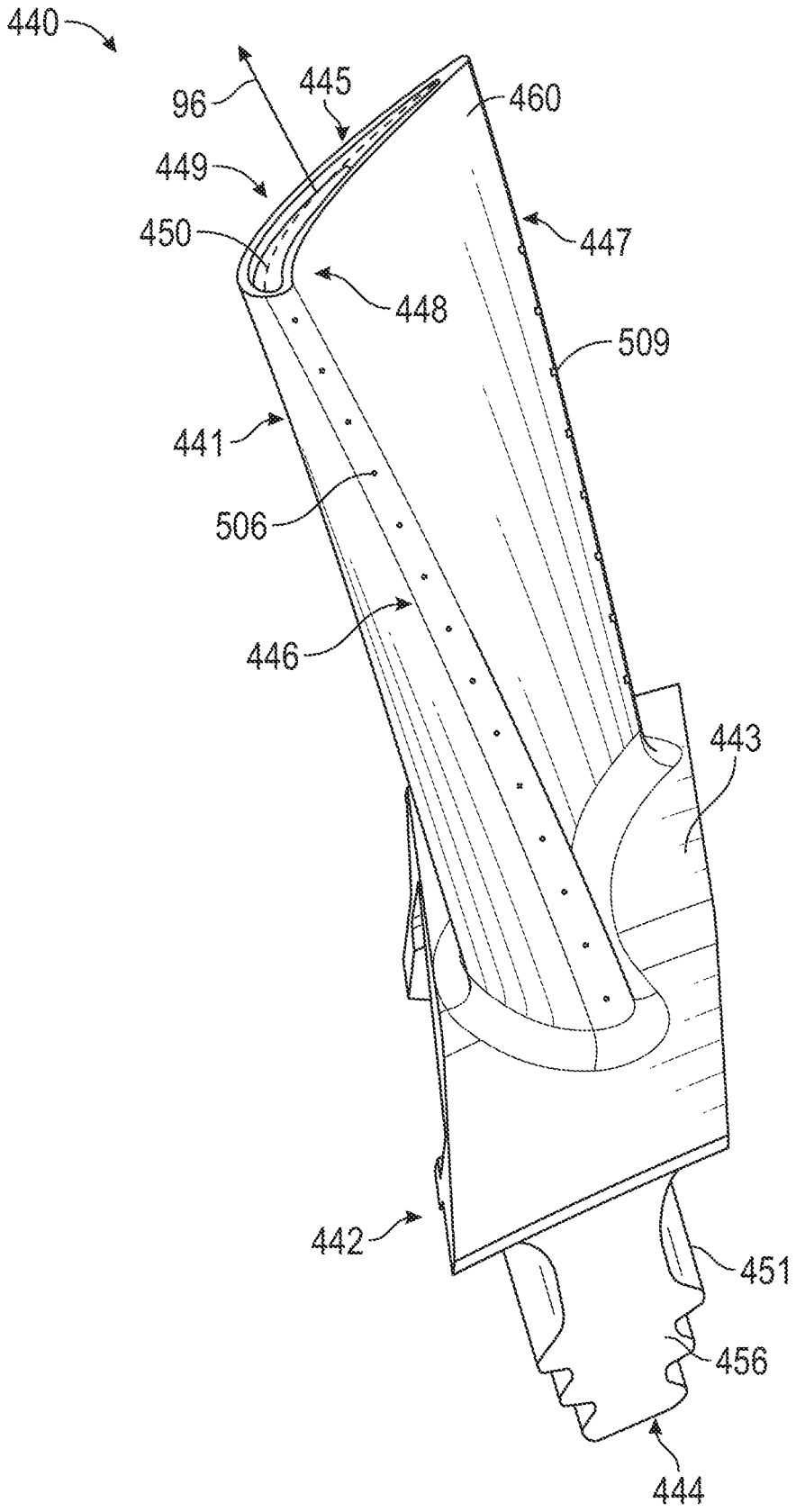
FIG. 3 is an isometric view of one turbine blade of FIG. 2.

FIG. 3 is a perspective view of the turbine blade of FIG. 2. As described above, the cooled turbine blade 440*a* may include a base 442 having a platform 443, a blade root 451, and a root end 444. Each cooled turbine blade 440*a* may further include an airfoil 441 extending radially outward from the platform 443. The airfoil 441 may have a complex, geometry that varies radially. For example the cross section of the airfoil 441 may lengthen, thicken, twist, and/or change shape as it radially approaches the platform 443 inward from a tip end 445. The overall shape of airfoil 441 may also vary from application to application.

The cooled turbine blade 440*a* is generally described herein with reference to its installation and operation. In particular, the cooled turbine blade 440*a* is described with reference to both a radial 96 of center axis 95 (FIG. 1) and the aerodynamic features of the airfoil 441. The aerodynamic features of the airfoil 441 include a leading edge 446, a trailing edge 447, a pressure side 448, a suction side 449, and its mean camber line 450. The leading edge 446 and the trailing edge 447, either one of which can be referred to a first edge or a second edge. The leading edge 446 may have leading edge holes 506 and trailing edge 447 may have trailing edge slots 509 that can permit cooling air 15 to exit the turbine blade 440*a*. The mean camber line 450 is generally defined as the line running along the center of the airfoil from the leading edge 446 to the trailing edge 447. It can be thought of as the average of the pressure side 448 and suction side 449 of the airfoil 441 shape. As discussed above, airfoil 441 also extends radially between the platform 443 and the tip end 445. Accordingly, the mean camber line 450 herein includes the entire camber sheet continuing from the platform 443 to the tip end 445.

Thus, when describing the cooled turbine blade 440*a* as a unit, the inward direction is generally radially inward toward the center axis 95 (FIG. 1), with its associated end called a "root end" 444. Likewise the outward direction is generally radially outward from the center axis 95 (FIG. 1), with its associated end called the "tip end" 445. When describing the platform 443, the forward face 456 and the aft face 457 of the platform 443 is associated to the forward and aft axial directions of the center axis 95 (FIG. 1), as described above. The base 442 can further include a forward face 456 and an aft face 457. The forward face 456 corresponds to the face of the base 442 that is located on the forward end of the base 442. The aft face 457 corresponds to the face of the base 442 that is located distal from the forward face 456.

In addition, when describing the airfoil 441, the forward and aft directions are generally measured between its leading edge 446 (forward) and its trailing edge 447 (aft), along the mean camber line 450 (artificially treating the mean camber line 450 as linear). When describing the flow features of the airfoil 441, the inward and outward directions are generally measured in the radial direction relative to the center axis 95 (FIG. 1). However, when describing the thermodynamic features of the airfoil 441 the inward and outward directions are generally measured in a plane perpendicular to a radial 96 of center axis 95 (FIG. 1) with inward being toward the mean camber line 450 and outward being toward the "skin" 460 of the airfoil 441.

Finally, certain traditional aerodynamics terms may be used from time to time herein for clarity, but without being limiting. For example, while it will be discussed that the airfoil 441 (along with the entire cooled turbine blade 440*a*) may be made as a single metal casting, the outer surface of the airfoil 441 (along with its thickness) is descriptively called herein the "skin" 460 of the airfoil 441. In another example, each of the ribs described herein can act as a wall or a divider.

Figure 4:
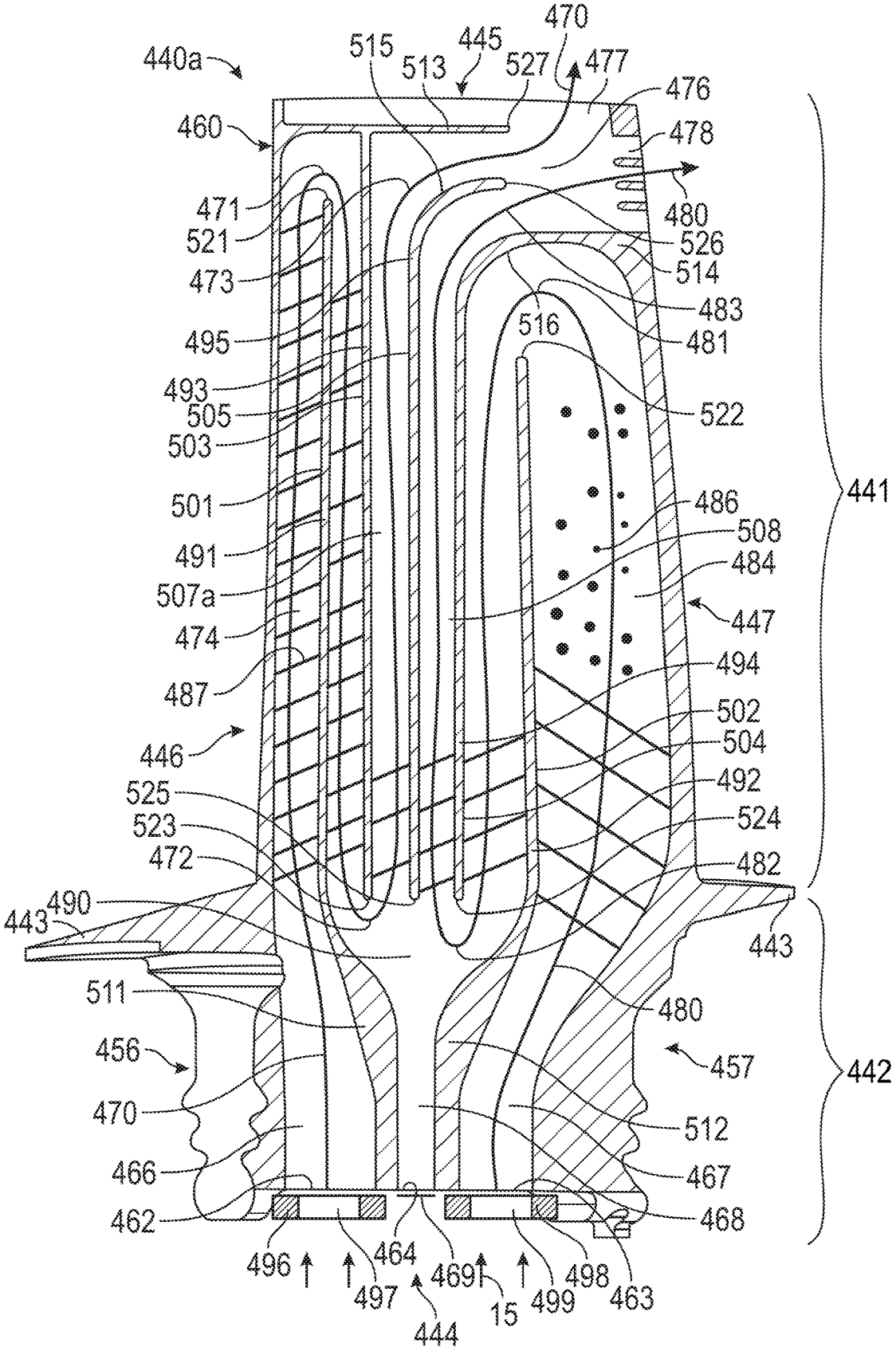
FIG. 4 is a cutaway side view of the turbine blade of FIG. 3.

FIG. 4 is a cutaway side view of the turbine blade of FIG. 3. In particular, the cooled turbine blade 440*a* of FIG. 3 is shown here with the skin 460 removed from the pressure side 448 of the airfoil 441, exposing its internal structure and cooling paths. The airfoil 441 may include a composite flow path made up of multiple subdivisions and cooling structures. Similarly, a section of the base 442 has been removed to expose portions of a first inlet passage 466, a second inlet passage 467, and a third inlet passage 468 internal to the base 442. The turbine blade 440*a* shown in FIG. 4 generally depicts the features visible from the pressure side 448. The leading edge holes 506 and the trailing edge slots 509 have not been shown in FIG. 4.

The cooled turbine blade 440*a* includes an airfoil 441 and a base 442. The base 442 may include the platform 443, the blade root 451, the forward face 456, the aft face 457, the root end 444, a first inlet 462, a second inlet 463, and a third inlet 464. The airfoil 441 interfaces with the base 442 and may include the skin 460, a first divider 491, a second divider 492, a third divider 493, a fourth divider 494, and a fifth divider 495.

Compressed secondary air 15 may be routed into the first inlet 462, second inlet 463, and third inlet 464 in the base 442 of cooled turbine blade 440*a* as cooling air 15. The first inlet 462, second inlet 463, and third inlet 464 may be at any convenient location. For example, here, the first inlet 462, second inlet 463, and third inlet 464 are located in the blade root 451. Alternately, cooling air 15 may be received in a shank area radially outward from the blade root 451 but radially inward from the platform 443. The first inlet 462 may be located between the forward face 456 and the third inlet 464. The first inlet 462 is configured to allow compressed cooling air 15 into the turbine blade 440*a*. The second inlet 463 may be located between the third inlet and the aft face 457. The second inlet 463 is configured to allow compressed cooling air 15 into the turbine blade 440*a*. The third inlet 464 may be located between the first inlet 462 and the second inlet 463. In an embodiment, a blocking plate 469 may be located radially inward of the third inlet 464 and can restrict the cooling air 15 from entering the third inlet 464. In some embodiments the third inlet 464 and third inlet passage are present to aid in casting the cooled turbine blade 440*a*.

Within the base 442, the cooled turbine blade 440*a* includes a first inlet passage 466 configured to route cooling air 15 from the first inlet 462, through the base 442, and into the airfoil 441 via a first channel 474. The base may also include a second inlet passage 467 configured to route cooling air 15 from the second inlet 463, through the base 442, and into the airfoil 441 via the second channel 484. The base 442 may also include a third inlet passage 468 that is configured to route cooling air 15 from the third inlet 464, through the base 442 and into the airfoil 441 via a middle channel 490. The first inlet passage 466, second inlet passage 467, and third inlet passage 468 may be configured to translate the cooling air 15 in three dimensions (e.g., not merely in the plane of the figure) as it travels radially up (e.g., generally along a radial 96 of the center axis 95 (FIG. 1)) towards the airfoil 441 and along a first multi-bend heat exchange path 470 and a second multi-bend heat exchange path 480. For example, the cooling air 15 can travel radially and within the airfoil 441. The first multi-bend heat exchange path 470 and the second multi-bend heat exchange path 480 are depicted as solid lines drawn as a weaving path through the airfoil 441, exiting through the airfoil 441 and ending with an arrow. The first multi-bend heat exchange path 470 may be an air flow path partially confined by the first channel 474 and the second multi-bend heat exchange path 480 may be an air flow path partially confined by the second channel 484.

Within the skin 460 of the airfoil 441 and the base 442 of the turbine blade, several internal structures are viewable. Several of the internal structures, such as the first divider 491, the second divider 492, the third divider 493, the fourth divider 494, and the fifth divider 495, may remain continuous or include gaps. In addition, the airfoil 441 may include turbulators 487, cooling fins 486, a trailing edge outlet 478, and a tip opening 477.

In an embodiment, the first divider 491 is located within the airfoil 441 and the base 442 and extends from the base 442 and up into the airfoil 441. The first divider 491 can be located between the first inlet passage 466 and the third inlet passage 468 and extend from the root end 444 towards the tip end 445. The first divider 491 can extend from the pressure side 448 of the skin 460 to the suction side 449 of the skin 460. The first divider 491 can have a first transition portion 511 and a first rib portion 501.

The first transition portion 511 can extend from between the first inlet 462 and the third inlet 464 located proximate the root end 444 to proximate the leading edge 446 located proximate to the interface of the airfoil 441 and the base 442. In other words, the first transition portion 511 can bend towards the leading edge 446 as it extends from proximate the root end 444 towards the tip end 445 when located within the base 442. The first transition portion 511 can be wider adjacent the root end 444 than opposite from the root end 444.

The first rib portion 501 can extend from the first transition portion 511 located proximate the interface of the airfoil 441 and the base 442 towards the tip end 445. The first rib portion 501 can extend generally parallel with the leading edge 446 and can have a generally liner shape.

The first divider 491 may include a first end 521 located opposite from the base 442. The first end 521 may be located closer to the leading edge 446 than the first divider 491 proximate the root end 444.

In an embodiment, the second divider 492 is located within the airfoil 441 and the base 442 and extends from the base 442 and up into the airfoil 441. The second divider 492 can be located between the second inlet passage 467 and the third inlet passage 468 and extend from the root end 444 towards the tip end 445. The second divider 492 can extend from the pressure side 448 of the skin 460 to the suction side 449 of the skin 460. The second divider 492 can be located between the first divider 491 and the trailing edge 447. The second divider 492 can be located closer to the trailing edge 447 than the first divider 491. The second divider 492 can have a second transition portion 512 and a second rib portion 502.

The second transition portion 512 can extend from between the second inlet 463 and the third inlet 464 located proximate the root end 444 to proximate the trailing edge 447 located proximate to the interface of the airfoil 441 and the base 442. In other words, the second transition portion 512 can bend towards the trailing edge 447 as it extends from proximate the root end 444 towards the tip end 445 when located within the base 442. The second transition portion 512 can be wider adjacent the root end 444 than opposite from the root end 444.

The second rib portion 502 can extend from the second transition portion 512 located proximate the interface of the airfoil 441 and the base 442 towards the tip end 445. The second rib portion 502 can extend generally parallel with the trailing edge 447 and can have a generally liner shape. The second rib portion 502 can be shorter than the first rib portion 501.

The second divider 492 may include a second end 522 located opposite from the base 442. The second end 522 may be located closer to the trailing edge 447 than the second divider 492 proximate the root end 444.

In an embodiment third divider 493 extend from the proximate the tip end 445 towards the base and may end proximate first transition portion 511 and proximate to the interface of the airfoil 441 and the base 442. The third divider 493 can extend from the pressure side 448 of the skin 460 to the suction side 449 of the skin 460. The third divider 493 can include a third transition portion 513 and a third rib portion 503.

In an embodiment, the third transition portion 513 extends from leading edge 446 towards the trailing edge 447. The third transition portion 513 can be located between the first divider 491 and the tip end 445. The third transition portion 513 can be located proximate to the tip end 445. The third transition portion 513 can be wider adjacent the leading edge and taper narrower as it extends from the leading edge 446 such as the shape of a filet.

The third divider 493 may have a third transition end 527 that is located opposite from the leading edge 446. The third transition end 527 may be located proximate to the tip opening 477 and trailing edge outlet 478.

The third rib portion 503 can extend from the third transition portion 513 towards the base 442 and root end 444. The third rib portion 503 can extend from proximate the tip end 445 towards the base 442. In an embodiment, the third rib portion 503 extends from approximately the middle of the third transition portion 513, from between the leading edge 446 and the third transition end 527. The third rib portion 503 can extend from the third transition portion 513 to proximate to the first transition portion 511 and the interface of where the airfoil 441 extends from the base 442. The third rib portion 503 can be located between the first divider 491 and the second rib 502. The third rib portion 503 can be positioned closer to the first rib portion 501 than the second rib 502. The third rib portion 503 can be located between the first divider 491 and the trailing edge 447. The third rib portion 503 can be oriented generally parallel with the first divider 491. The third rib portion 503 can be longer than the first rib portion 501 and the second rib portion 502.

The third divider 493 may include a third end 523 located opposite from the tip end 445. The third end 523 may be located closer to the leading edge 446 than the third transition end 527.

The fourth divider 494 may extend from the pressure side 448 of the skin 460 to the suction side 449 of the skin 460 and include a fourth transition portion 514, a fourth rib transition portion 516, and a fourth rib portion 504.

The fourth transition portion 514 can extend from the trailing edge 447 towards the leading edge 446 and be located between the second divider 492 and the tip end 445. The fourth transition portion 514 can be is wider adjacent to the trailing edge 447 and taper narrower away from the trailing edge and have a filet shape. The fourth transition portion 514 can be located between the third rib portion 503 and the trailing edge 447. The fourth transition portion can be located proximate to the trailing edge outlets 478.

The fourth rib transition portion 516 extends from the fourth transition portion 514 towards the base 442. The fourth rib transition portion 516 can be located between the third transition portion 513 and the second rib portion 502. The fourth rib transition portion 516 may be shaped as a fixed radial transition joining the fourth transition portion 514 to the fourth rib portion 504.

The fourth rib portion 504 can extend from the fourth rib transition portion 516 towards the root end 444. The fourth rib portion 504 can extend from proximate the fourth transition portion 514 towards the root end 444. The fourth rib portion 504 can extend from the fourth rib transition portion 516 to proximate to the second rib portion 502 and the interface of where the airfoil 441 extends from the base 442. The fourth rib portion can be located between the third rib portion 503 and the second rib portion 502. The fourth rib portion 504 can be positioned closer to the second rib portion 502 than the third rib portion 503. The fourth rib portion 504 can be oriented generally parallel with the third rib portion 503. The fourth rib portion 504 may be located closer to the leading edge 446 than the fourth transition portion 514. The fourth rib portion 504 can be shorter than the third rib portion 503 and the first rib portion 501. The fourth rib portion 504 can be longer than the second rib portion 502

The fourth divider 494 may include a fourth end 524 rib located opposite from the tip end 445. The fourth end 524 may be located at a similar radial distance as the third end 523.

The fifth divider 495 can extend from proximate the interface of where the airfoil 441 extends from the base 442 towards the tip end 445 and be positioned between the third divider 493 and the fourth divider 494. The fifth divider 495 may extend from the pressure side 448 of the skin 460 to the suction side 449 of the skin 460 and include a fifth rib portion 505 and a fifth transition portion 515.

The fifth rib portion 505 can extend from proximate the third end 523 and the fourth end 524 to proximate the fourth rib transition portion 516. In other words, the fifth rib portion can extend from proximate the interface of the airfoil and the base towards the tip end 445. The fifth rib portion 505 can be position between the third rib portion 503 and the trailing edge 447. The fifth rib portion 505 can be position between the third rib portion 503 and the fourth rib portion 504. The fifth rib portion 505 can be oriented generally parallel with the third rib portion 503 and the fourth rib portion 504 and be generally linear. The fifth rib portion 505 can be longer than the fourth rib portion 504 and shorter than the third rib portion 503. The fifth rib portion 505 can be closer to the leading edge 446 than the trailing edge 447

The fifth transition portion 515 extends from the fifth rib portion 505 towards the trailing edge outlet 478 of the trailing edge 447. In other words, the fifth transition portion 515 can extend from the fifth rib portion 505 radially towards the tip end 445 and extend from the fifth transition portion 515 circumferentially towards the trailing edge 447. The fifth transition portion 515 can be positioned between the fourth rib transition portion 516 and the third transition portion 513. The fifth transition portion 515 may be shaped to have a fixed radial curvature. Alternatively the fifth transition portion 515 can have multiple curvatures, or be linear and have no curvature.

The fifth divider 495 may include a fifth end 525 rib located opposite from the tip end 445. The fifth end 525 may be located at a similar radial distance as the third end 523 and fourth end 524.

The fifth divider 495 may include a fifth transition end 526 located opposite from the fifth end 525. The fifth transition end 526 can be located proximate to the third transition end 527.

The tip opening 477 is defined by the space between the pressure side 448 of the skin 460, the suction side 449 of the skin, third transition portion 513, and the trailing edge 447. The tip opening 477 allows for cooling air 15 to escape the airfoil 441 through the tip end 445.

The trailing edge outlet 478 extends through the trailing edge 447 and is located proximate the tip end 445. The trailing edge outlet 478 allows for cooling air 15 to escape the airfoil 441 through the trailing edge 447.

The turbine blade 440*a* can include a middle channel 490 that is defined by (and includes the space between) the first transition portion 511, the second transition portion 512, the pressure side 448 of the skin 460, and the suction side 449 of the skin 460. The middle channel 490 can be located proximate to the third end 523, the fourth end 524, and the fifth end 525.

The airfoil 441 may include a tip end channel 476 that is defined by (and includes the space between) the fourth transition portion 514, the third transition portion 513, the trailing edge 447, the pressure side 448 of the skin 460, and the suction side 449 of the skin 460. The tip end channel 476 can be located adjacent to the tip opening 477, the trailing edge outlet 478, the third transition end 527, the fifth transition end 526.

Together with the skin 460, the described structures, may define first multi-bend heat exchange path 470 along with the second multi-bend heat exchange path 480 within the airfoil 441.

The first multi-bend heat exchange path 470 can flow through a first channel 474 and a third channel 507*a* of the turbine blade 440*a*. The first channel 474 can include the space between (and is defined by) the leading edge 446, the first rib portion 501, the third rib portion 503, the third transition portion 513, the pressure side 448 of the skin 460, and the suction side 449 of the skin 460. The first channel 474 can extend from proximate the interface of the airfoil 441 and the base 442 to the third transition portion 513 while between the leading edge 446 and the first divider 491. The first channel 474 can further extend around the first end 521, between the first divider 491 and the third transition portion 513, and further to between the first divider 491 and the third rib portion 503 to proximate the interface of the airfoil 441 and the base 442. The first channel 474 can be partially located adjacent to the leading edge 446.

The third channel 507*a* can be defined by (and includes the space between) the third rib portion 503, the third transition portion 513, the fifth rib portion 505, the fifth transition portion 515, the pressure side 448 of the skin 460, and the suction side 449 of the skin 460. The third channel 507*a* can extend from proximate the interface of the airfoil 441 and the base 442 towards the tip end 445 while between the third rib portion 503 and the fifth rib portion 505. The third channel 507*a* can further extend between the third transition portion 513 and the fifth transition portion 515 to proximate the tip end 445. In other words, the third channel 507*a* can extend between the third transition portion 513 and the fifth transition portion 515 to proximate the third transition end 527 and the fifth transition end 526.

The second multi-bend heat exchange path 480 can flow through a second channel 484 and a fourth channel 508 of the turbine blade 440*a*. The second channel 484 can be defined by (and includes the space between) the trailing edge 447, the second rib portion 502, the fourth rib portion 504, the fourth transition portion 514, the fourth rib transition portion 516, the pressure side 448 of the skin 460, and the suction side 449 of the skin 460. The second channel 484 can extend from proximate the interface of the airfoil 441 and the base 442 to the fourth transition portion 514 while between the trailing edge 447 and the second divider 492. The second channel 484 can further extend around the second end 522, between the second divider 492 and the fourth transition portion 514 and fourth rib transition portion 516, and further to between the second divider 492 and the fourth rib portion 504 to proximate the interface of the airfoil 441 and the base 442. The second channel 484 can be partially located adjacent to the trailing edge 447.

The fourth channel 508 can be defined by (and includes the space between) the fourth rib portion 504, the fourth rib transition portion 516, the fifth rib portion 505, the fifth transition portion 515, the pressure side 448 of the skin 460, and the suction side 449 of the skin 460. The fourth channel 508 can extend from proximate the interface of the airfoil 441 and the base 442 towards the tip end 445 while between the fifth rib portion 505 and the fourth rib portion 504. The fourth channel 508 can further extend between the fifth transition portion 515 and the fourth transition 514 portion to proximate the tip end 445.

The internal structures making up the first multi-bend heat exchange path 470 and second multi-bend heat exchange path 480 may form multiple discrete sub-passageways. For example, although the first multi-bend heat exchange path 470 and the second multi-bend heat exchange path 480 are shown by a representative path of cooling air 15, multiple composite flow paths are possible.

The possible multiple composite flow paths may encounter additional features within the airfoil 441. These features may be turbulators 487 and cooling fins 486.

In an embodiment, the turbulators 487 may be located between the leading edge 446 and the first rib portion 501, between the first rib portion 501 and third rib portion 503, between the third rib portion 503 and the fifth rib portion 505, between the fifth rib portion 505 and the fourth rib portion 504, between the fourth rib portion 504 and the second rib portion 502, and between the second rib portion 502 and the trailing edge 447. The turbulators 487 can be distributed throughout the other remaining areas of the airfoil 441 as well. The turbulators 487 can be formed as ridges on the skin 460 and can be operable to interrupt flow along the first multi-bend heat exchange path 470 and second multi-bend heat exchange path 480 and prevent formation of a boundary layer which can decrease cooling effects of the cooling air 15.

The cooling fins 486 may extend from the pressure side 448 of the skin 460 to the suction side 449 of the skin 460. In an embodiment the cooling fins 486 are located between the second rib portion 502 and the trailing edge 447. The cooling fins 486 may be disbursed copiously throughout the airfoil 441 or in other selected locations. In particular, the cooling fins 486 may be disbursed throughout the airfoil 441 so as to thermally interact with the cooling air 15 for increased cooling. The distribution may be regular, irregular, staggered, and/or localized. According to one embodiment, one or more of the cooling fins 486 may be pin fins or pedestals. The pin fins or pedestals may include many different cross-sectional areas, such as: circular, oval, racetrack, square, rectangular, diamond cross-sections, just to mention only a few. As discussed above, the pin fins or pedestals may be arranged as a staggered array, a linear array, or an irregular array.

The turbine blade 440*a* may further include a first metering plate 496. The first metering plate 496 can be located adjacent to and radially inward of the first inlet 462 with respect to the center axis 95. The first metering plate 496 may extend from the adjacent the first divider 491 towards the forward face 456. The first metering plate 496 may include a first metering plate inlet 497.

The turbine blade 440*a* may further include a second metering plate 498. The second metering plate 498 can be located adjacent to and radially inward of the second inlet 463 with respect to the center axis 95. The second metering plate 498 may extend from the adjacent the first divider 491 towards the forward face 456. The second metering plate 498 may include a second metering plate inlet 499.

The size of the second metering plate inlet 499 can be selected to provide a desired amount or flow of cooling air 15 to the second channel 484. In an embodiment, the first metering plate inlet 497 is located between the second metering plate 498 and the forward face 456. The size of the first metering plate inlet 497 can selected to provide a desired amount or flow of cooling air 15 to the first channel 474.

Figure 5:
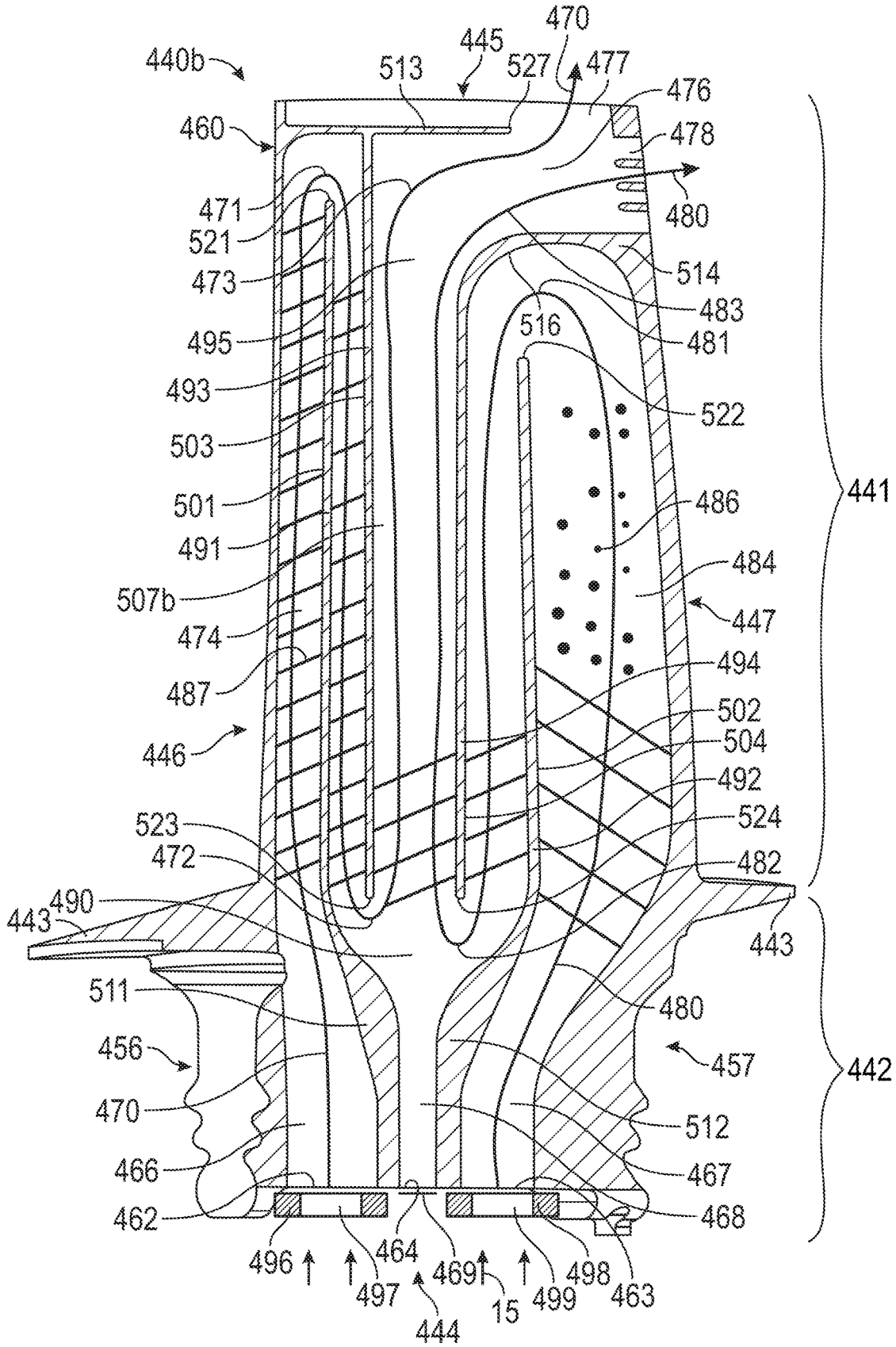
FIG. 5 is a further cutaway side view of the turbine blade of FIG. 3 showing a variation in the cooling paths.

FIG. 5 is a further cutaway side view of the turbine blade of FIG. 3 showing a variation in the cooling paths. Structures and features previously described in connection with earlier described embodiments may not be repeated here with the understanding that, when appropriate, that previous description applies to the embodiment depicted in FIG. 5. Additionally, the emphasis in the following description is on variations of previously introduced features or elements. The alternative turbine blade 440*b* is similar to turbine blade 440*a*, but has the fifth divider 495 (shown in FIG. 4) removed.

With the fifth divider 495 removed, the third channel 507*b* becomes defined by (and includes the space between) the third rib portion 503, third transition portion 513, the fourth rib portion 504, the fourth rib transition portion 516, the pressure side 448 skin 460 and the suction side 449 skin 460. Both the first multi-bend heat exchange path 470 and the second multi-bend heat exchange path 480 can flow through the third channel 507*b* and can create a combined multi-bend heat exchange path. The third channel 507*b* can extend from proximate the interface of the airfoil 441 and the base 442 towards the tip end 445 while between the third rib portion 503 and the fourth rib portion 504. The third channel 507*b* can further extend between the third transition portion 513 and the fourth rib transition portion 516 to proximate the tip end 445. In other words, the third channel 507*b* can extend between the third transition portion 513 and the fourth rib transition portion 516 to proximate the third transition end 527 and the fourth transition portion 514.

INDUSTRIAL APPLICABILITY

The present disclosure generally applies to cooled turbine blades 440*a*, 440*b*, and gas turbine engines 100 having cooled turbine blades 440*a*, 440*b*. The described embodiments are not limited to use in conjunction with a particular type of gas turbine engine 100, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and suctioning of oil and natural gas), power generation industry, cogeneration, aerospace and transportation industry, to name a few examples.

Generally, embodiments of the presently disclosed cooled turbine blades 440*a,b* are applicable to the use, assembly, manufacture, operation, maintenance, repair, and improvement of gas turbine engines 100, and may be used in order to improve performance and efficiency, decrease maintenance and repair, and/or lower costs. In addition, embodiments of the presently disclosed cooled turbine blades 440*a,b* (FIGS. 4 and 5) may be applicable at any stage of the gas turbine engine's 100 life, from design to prototyping and first manufacture, and onward to end of life. Accordingly, the cooled turbine blades 440*a,b* may be used in a first product, as a retrofit or enhancement to existing gas turbine engine, as a preventative measure, or even in response to an event. This is particularly true as the presently disclosed cooled turbine blades 440*a,b* may conveniently include identical interfaces to be interchangeable with an earlier type of cooled turbine blades 440*a,b*.

As discussed above, the entire cooled turbine blade 440*a,b* may be cast formed. According to one embodiment, the cooled turbine blade 440*a,b* may be made from an investment casting process. For example, the entire cooled turbine blade 440*a,b* may be cast from stainless steel and/or a superalloy using a ceramic core or fugitive pattern. Notably, while the structures/features have been described above as discrete members for clarity, as a single casting, the structures/features may be integrated with the skin 460. Alternately, certain structures/features may be added to a cast core, forming a composite structure.

Embodiments of the presently disclosed cooled turbine blades 440*a,b* provide for an increase in cooling capacity, which makes the turbine blades 440*a,b* more appealing to stationary gas turbine engine applications. In particular, the serpentine configuration provides for improved cooling at the leading edge 446 and trailing edge 447 of the airfoil 441 by providing the coolest cooling air 15 to the leading edge 446 and trailing edge 447 first and gradually directing the cooling air 15 towards the fifth divider 495, which can generally be a circumferential middle portion of the airfoil 441 with respect to the leading edge 446 and trailing edge 447. The warmed cooling air 15, also referred to as spent cooling air, is initially warmed by the leading edge 446 and trailing edge 447 and is directed away from the leading edge 446 and trailing edge 447 to cool the structural features positioned toward the middle of the airfoil 441, where experienced temperatures during turbine engine operation can be typically lower in comparison to temperatures of the leading edge 446 and trailing edge 447.

In a disclosed embodiment, the pressurized cooling air 15 can be generally coolest as it is received by a first metering plate 496 having a first metering plate inlet 497. The cooling air 15 can pass through the first metering plate inlet 497 and be received by the first inlet 462. Similarly, the pressurized cooling air 15 can be generally coolest as it is received by a second metering plate 498 having a second metering plate inlet 499. The cooling air 15 can pass through the second metering plate inlet 499 and be received by the second inlet 463.

In the embodiments shown in FIG. 4 and FIG. 5, the first multi-bend heat exchange path 470 can be a path that the cooling air 15 follows through the turbine blade 440*a,b*. The cooling air 15 can follow the first multi-bend heat exchange path 470 that can extend from the first inlet 462 in a generally radial direction towards the tip end 445. The cooling air 15 follows the first multi-bend heat exchange path 470 that further extends from the first inlet 462 to between the first transition portion 511 and the base 442 located proximate to the forward face 456. In other words, the cooling air 15 flows from the first inlet 462 to adjacent the first transition portion 511 and adjacent the base 442 located proximate to the forward face 456. The cooling air 15 follows the first multi-bend heat exchange path 470 that further extends from within the base 442 to between the leading edge 446 and the first rib portion 501, towards the third transition portion 513. In other words, the cooling air 15 is received by the first channel 474. The cooling air 15 follow the first multi-bend heat exchange path that further extends adjacent to the leading edge 446 and the first rib portion 501 to provide cooling effects to the leading edge 446 and first rib portion 501 prior to cooling of areas located further from the leading edge 446 and first rib portion 501. In other words the cooling air 15 can absorb heat from the leading edge 446 and other adjacent features such as the skin 460 and first rib portion 501. The cooling air 15 can become progressively warmer as the cooling air 15 progresses through the airfoil 441 along the first multi-bend heat exchange path 470 and through the first channel 474 and third channel 507*a,b*.

The cooling air 15 can follow a first turn 471 of the first multi-bend heat exchange path 470, around the first end 521, changing the direction of cooling air 15 from flowing towards the third transition portion 513 to towards the base 442 and root end 444. The first multi-bend heat exchange path 470 can further extend towards the base 442 and root end 444 while between the first rib portion 501 and third rib portion 503.

In other words, the first channel 474 directs the cooling air 15 between the first divider 491 and the third rib portion 503 towards the first inlet 462. The cooling air 15 can absorb additional heat and provide cooling effects to the first rib portion 501, the third rib portion 503, the third transition portion 513, and features located between the first rib portion 501, the third rib portion 503, the third transition portion 513, such as a portion of the skin 460.

The cooling air 15 can follow the first multi-bend heat exchange path 470 that further extends around the third end 523 and may extend through a middle channel 490. In other words, the cooling air 15 is received by a middle channel 490 and directed into the third channel 507*a,b*. Though not shown, a portion or all of the cooling air 15 may be directed from the middle channel 490 to the fourth channel 508.

As shown in FIG. 5, the cooling air 15 can follow the first multi-bend heat exchange path 470 that further extends around the third end 523 to between the third rib portion 503 and fourth rib portion 504. In other words the cooling air 15 can transition from the first channel 474, through the middle channel 490, and to the third channel 507*b* by following a second turn 472 of the first multi-bend heat exchange path 470. In other words, the cooling air 15 flows around the third rib portion 503, and the additionally warmed cooling air 15 is directed between the third rib portion 503 and the fourth rib portion 504 towards the tip end 445. The cooling air 15 can absorb additional heat and provide cooling effects to the third rib portion 503, the fourth rib portion 504, and features located between the third rib portion 503 and fourth rib portion 504, such as a portion of the skin 460.

The cooling air 15 can follow the first multi-bend heat exchange path 470 that further extends between the third transition portion 513 and the fourth rib transition portion 516 towards the trailing edge 447. In other words the cooling air 15 can follow a third turn 473 of the first multi-bend heat exchange path 470 around the fourth rib transition portion 516 and between the fourth rib portion 504, third rib portion 503, third transition portion 513, and the fourth rib transition portion 516. In other words, the cooling air 15 flows through the third channel 507*b* and is directed into the tip end channel 476.

As shown in FIG. 4, the cooling air 15 can follow the first multi-bend heat exchange path 470 that further extends around the third end 523 to between the third rib portion 503 and fifth rib portion 505. In other words, the cooling air 15 can transition from the first channel 474, through the middle channel 490, and to the third channel 507*a* by following a second turn 472 of the first multi-bend heat exchange path 470. In other words, the cooling air 15 flows around the third rib portion 503, and the additionally warmed cooling air 15 is directed between the third rib portion 503 and the fifth rib portion 505 towards the tip end 445. The cooling air 15 can absorb additional heat and provide cooling effects to the third rib portion 503, the fifth rib portion 505, and features located between the third rib portion 503 and fifth rib portion 505, such as a portion of the skin 460.

The cooling air 15 can follow the first multi-bend heat exchange path 470 that further extends between the third transition portion 513 and the fifth transition portion 515 towards the trailing edge 447. In other words the cooling air 15 can follow a third turn 483 of the second multi-bend heat exchange path 480 around the fifth transition portion 515 and between the fifth rib portion 505, fifth transition portion 515, third rib portion 503, and third transition portion 513. In other words, the cooling air 15 flows through the third channel 507*a* and is directed into the tip end channel 476.

As shown in FIG. 4 and FIG. 5, the cooling air 15 can be directed into the tip end channel 476 where it can follow the first multi-bend heat exchange path 470 through the tip opening 477 of the tip end 445. The cooling air 15 can absorb additional heat and provide cooling effects to the tip opening 477 and features proximate to the tip opening 477, such as a portion of the skin and the trailing edge outlet 478.

In an example, the additionally warmed cooling air 15 follows the first multi-bend heat exchange path 470 through the trailing edge outlet 478 of the trailing edge 447. The cooling air 15 can absorb additional heat and provide cooling effects to the trailing edge outlet 478 and features proximate to the trailing edge outlet 478 such as a portion of the tip end 445 and a portion of the skin 460.

In an example, the additionally warmed cooling air 15 follows the first multi-bend heat exchange path 470 partially through the tip end 445 and partially through the trailing edge outlet 478 and provide a combination of the cooling effects described previously.

In the embodiments shown in FIG. 4 and FIG. 5, the second multi-bend heat exchange path 480 can be a path that the cooling air 15 follows through the turbine blade 440*a,b*. The cooling air 15 can follow the second multi-bend heat exchange path 480 that can extend from the second inlet 463 in a generally radial direction towards the tip end 445. The cooling air 15 follows the second multi-bend heat exchange path 480 that extends from the second inlet 463 to between the second transition portion 512 and the base 442 located proximate to the aft face 457. In other words, the cooling air 15 flows from the second inlet 463 to adjacent the second transition portion 512 and adjacent the base 442 located proximate to the aft face 457. The cooling air 15 follows the second multi-bend heat exchange path 480 that extends from within the base 442 to between the trailing edge 447 and the second rib portion 502, towards the fourth transition portion 514. In other words, the cooling air 15 is received by the second channel 484. The cooling air 15 follows the second multi-bend heat exchange path that extends from adjacent to the trailing edge 447 to provide cooling effects to the trailing edge 447 prior to cooling of areas located further from the trailing edge 447. In other words the cooling air 15 can absorb heat from the trailing edge 447 and other adjacent features such as the skin 460 and second rib portion 502. The cooling air 15 can become progressively warmer as the cooling air 15 progresses through the airfoil 441 along the second multi-bend heat exchange path 480 and through the second channel 484, third channel 507*b* (shown in FIG. 5) and fourth channel 508 (shown in FIG. 4).

The cooling air 15 can follow a first turn 481 of the second multi-bend heat exchange path 480, around the second end 522, changing the direction of cooling air 15 from flowing towards the fourth rib transition portion 516 to towards the base 442 or root end 444. The second multi-bend heat exchange path 480 can further extend towards the base 442 and root end 444 while between the second rib portion 502 and the fourth rib portion 504.

In other words, the second channel 484 directs the warmed cooling air 15 between the second rib portion 502 and the fourth rib portion 504 towards the second inlet 463. The cooling air 15 can absorb additional heat and provide cooling effects to the second rib portion 502, the fourth rib portion 504, the fourth rib transition portion 516, the fourth rib portion 504, and features located between the second rib portion 502, the fourth rib portion 504, the fourth rib transition portion 516, and the fourth rib portion 504 such as a portion of the skin 460.

The cooling air 15 can follow the second multi-bend heat exchange path 480 that further extends around the fourth end 524 and may extend through a middle channel 490. In other words, the cooling air 15 is received by a middle channel 490 and can be directed into the fourth channel 508 (shown in FIG. 4). Though not shown, a portion or all of the cooling air 15 may be directed from the middle channel 490 to the third channel 507*a* (shown in FIG. 4). A portion or all of the cooling air 15 may be directed from the middle channel 490 to the third channel 507*b* (shown in FIG. 5)

As shown in FIG. 5, the cooling air 15 can follow the second multi-bend heat exchange path 480 that further extends around the fourth end 524 to between the third rib portion 503 and fourth rib portion 504. In other words, the cooling air 15 can transition from the second channel 484, through the middle channel 490, and to the third channel 507*b* by following a second turn 482 of the second multi-bend heat exchange path 480. In other words, the cooling air 15 flows around the fourth rib portion 504, and the additionally warmed cooling air 15 is directed between the fourth rib portion 504 and the third rib portion 503 towards the tip end 445. The cooling air 15 can absorb additional heat and provide cooling effects to the fourth rib portion 504, the third rib portion 503, and features located between the fourth rib portion 504 and third rib portion 503, such as a portion of the skin 460.

The cooling air 15 can follow the second multi-bend heat exchange path 480 that further extends between the third transition portion 513 and the fourth rib transition portion 516 towards the trailing edge 447.

In other words, the cooling air 15 can follow a third turn 483 of the second multi-bend heat exchange path 480 around the fourth rib transition portion 516 and between the fourth rib portion 504, third rib portion 503, third transition portion 513, and the fourth rib transition portion 516. In other words, the cooling air 15 flows through the third channel 507*b* and is directed into the tip end channel 476.

As shown in FIG. 4, the cooling air 15 can follow the second multi-bend heat exchange path 480 that further extends around the fourth end 524 to between the fourth rib portion 504 and fifth rib portion 505. In other words, the cooling air 15 can transition from the second channel 484, through the middle channel 490, and to the fourth channel 508 by following a second turn 482 of the second multi-bend heat exchange path 480. In other words, the cooling air 15 flows around the fourth rib portion 504, and the additionally warmed cooling air 15 is directed between the fourth rib portion 504 and the fifth rib portion 505 towards the tip end 445. The cooling air 15 can absorb additional heat and provide cooling effects to the fourth rib portion 504, the fifth rib portion 505, and features located between the fourth rib portion 504 and third rib portion 503, such as a portion of the skin 460.

The cooling air 15 can follow the second multi-bend heat exchange path 480 that further extends between the third transition portion 513 and the fifth transition portion 515 towards the trailing edge 447. In other words, the cooling air 15 can follow a third turn 483 of the second multi-bend heat exchange path 480 around the fourth rib transition portion 516 and between the fourth rib portion 504, fourth rib transition portion 516, and the fifth transition portion 515. In other words, the cooling air 15 flows through the fourth channel 508 and is directed into the tip end channel 476.

As shown in FIG. 4 and FIG. 5, the cooling air 15 can be directed into the tip end channel 476 where it can follow the second multi-bend heat exchange path 480 through the tip opening 477 of the tip end 445. The cooling air 15 can absorb additional heat and provide cooling effects to the tip opening 477 and features proximate to the tip opening 477, such as a portion of the skin and the trailing edge outlet 478.

In an example, the additionally warmed cooling air 15 follows the second multi-bend heat exchange path 480 through the trailing edge outlet 478 of the trailing edge 447. The cooling air 15 can absorb additional heat and provide cooling effects to the trailing edge outlet 478 and features proximate to the trailing edge outlet 478 such as a portion of the tip end 445 and a portion of the skin 460.

In an example the additionally warmed cooling air 15 follows the second multi-bend heat exchange path 480 partially through the tip end 445 and partially through the trailing edge outlet 478 and provide a combination of the cooling effects described previously.

The first multi-bend heat exchange path 470 and the second multi-bend heat exchange path 480 are configured such that cooling air 15 will pass between, along, and around the various internal structures, but generally flows as serpentine paths, converging from the leading edge 446 and trailing edge 447 towards the middle of the airfoil 441, as viewed from the side view from the base 442 toward and away from the tip end 445 (e.g., conceptually treating the camber sheet as a plane). Accordingly, the first multi-bend heat exchange path 470 and the second multi-bend heat exchange path 480 may include some negligible lateral travel (e.g., into and out of the plane) associated with the general curvature of the airfoil 441. Also, as discussed above, although the first multi-bend heat exchange path 470 and the second multi-bend heat exchange path 480 are illustrated by two single representative flow lines traveling through two sections for clarity, first multi-bend heat exchange path 470 and the second multi-bend heat exchange path 480 include the entire flow path carrying cooling air 15 through the airfoil 441. The first multi-bend heat exchange path 470 and the second multi-bend heat exchange path 480 can be in flow communication with each and may combine within the middle channel 490, the third channels 507*a,b*, the fourth channel 508, and/or the tip end channel 476.

With the implementation of the dividers 491, 492, 493, 494, 495 the first multi-bend heat exchange path 470 and the second multi-bend heat exchange path 480 make use of the serpentine flow path with more efficient temperature distribution in comparison to single bend turbine blades. This provides for a higher cooling efficiency along the leading edge 446 and trailing edge 447.

The first metering plate 496 can have a first metering plate inlet 497 that can be sized and shaped to change the amount of cooling air 15 that enters the first inlet 462. Similarly, the second metering plate 498 can have a second metering plate inlet 499 that can be sized and shaped to change the amount of cooling air 15 that enters the second inlet 463. In an example, the first metering plate inlet 497 is sized larger than the second metering plate inlet 499, and can allow more cooling air 15 to enter the first inlet passage 466 than the second inlet passage 467. In an example, the first metering plate inlet 497 is sized smaller than the second metering plate inlet 499, and can allow less cooling air 15 to enter the first inlet passage 466 than the second inlet passage 467.

The turbine blade 440*a,b* can include a third inlet 464 and third inlet passage 468. The third inlet passage 468 can direct cooling air 15 to between the third rib portion 503 and the fourth rib portion 504. In an embodiment the third inlet passage 468 can direct cooling air 15 to between the third rib portion 503 and the fifth rib portion 505 and/or the fifth rib portion 505 and the fourth rib portion 504.

In an example the third inlet passage 468 is used to provide additional support during the turbine blade 440*a,b* casting process. The third inlet 464 may be covered with a blocking plate 469 to prevent cooling air 15 from entering through the third inlet 464 and into the third inlet passage 468.

In rugged environments, certain superalloys may be selected for their resistance to particular corrosive attack. However, depending on the thermal properties of the superalloy, greater cooling may be beneficial. The described method of manufacturing a cooled turbine blade 440*a,b* provides for implementing the dividers 491, 492, 493, 494, 495. In particular, the dividers 491, 492, 493, 494, 495 create a first multi-bend heat transfer path 470 and a second multi-bend heat transfer path 480 which achieve a more uniform temperature distribution of a turbine blade and increase cooling efficiency at lower airfoil spans and could increase blade life. Moreover, the internal airfoil structures including the dividers 491, 492, 493, 494, 495 can be suitable for use in turbine blades with thin blade airfoils.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A turbine blade for use in a gas turbine engine, the turbine blade comprising:

a base including a root end, a forward face, an aft face located opposite the forward face, a first inlet located proximate to the forward face, and a second inlet located between the first inlet and the aft face;

an airfoil comprising a skin extending from the base and defining a leading edge, a trailing edge opposite the leading edge, a pressure side, and a suction side opposite the pressure side, and having a tip end opposite from the root end;

a first transition portion extending from adjacent the first inlet towards the leading edge;

a first rib portion extending from the first transition portion opposite the root end towards the tip end, and having a first end located opposite from the root end, a third transition portion extending from the leading edge towards the trailing edge, located proximate to the tip end, and located between the first end and the tip end;

a third rib portion extending from the third transition portion towards the root end, located between the first rib portion and the trailing edge, the third rib portion located proximate to the first rib portion, and having a third end located opposite from the tip end;

a second transition portion extending from adjacent the second inlet towards the trailing edge;

a second rib portion extending from the second transition portion opposite the root end towards the tip end, the second rib portion located between the third rib portion and the trailing edge, the second rib portion having a second end located opposite the root end;

a fourth transition portion extending from the trailing edge towards the leading edge, located between the second end and the tip end;

a fourth rib transition portion extending from the fourth transition portion towards the root end, the fourth rib transition portion located between the third rib portion and the trailing edge; and a fourth rib portion extending from proximate the fourth transition portion, towards the root end, the fourth rib portion located between the third rib portion and the second rib portion, and the fourth rib portion having a fourth end located opposite from the tip end.

2. The turbine blade of claim 1, the turbine blade further comprising:

a fifth rib portion extending from proximate the third end and the fourth end towards the tip end, the fifth rib portion located between the third rib portion and fourth rib portion; and a fifth transition portion extending from the fifth rib portion, opposite from the root end, towards the trailing edge, the fifth transition portion located between the third transition portion and the fourth rib transition portion.

3. The turbine blade of claim 1, wherein the first transition portion extends radially from the first inlet towards the tip end, and extends circumferentially from the first inlet towards the leading edge.

4. The turbine blade of claim 1, wherein the second transition portion extends radially from the second inlet towards the tip end, and extends circumferentially from the second inlet towards the trailing edge.

5. The turbine blade of claim 1, the turbine blade further comprising:

a first metering plate located radially inward of the first inlet, the first metering plate having a first metering plate inlet sized to provide a desired amount of cooling air to the base, and a second metering plate located radially inward of the second inlet, the second metering plate having a second metering plate inlet sized to provide a desired amount of cooling air to the base.

6. A turbine blade for use in a gas turbine engine, the turbine blade comprising:

a base including a root end;

an airfoil comprising a skin extending from the base and defining a leading edge, a trailing edge opposite the leading edge, a pressure side, and a suction side opposite the pressure side, and having a tip end opposite from the root end;

a first divider located within the airfoil and the base, extending from within the base and into the airfoil, and having a first end located opposite from the base;

a third divider located within the airfoil, a portion of the third divider extending from the leading edge towards the trailing edge, located proximate to the tip end, and the third divider partially located between the first divider and the trailing edge;

a second divider located within the airfoil and the base, extending from the base and into the airfoil, partially located between the third divider and the trailing edge, the second divider having a second end located opposite from the base; and a fourth divider located within the airfoil, a portion of the fourth divider extending from the trailing edge towards the leading edge and located between the second divider and the tip end, the fourth divider partially located between the third divider and the second divider, and the fourth divider having a fourth end located opposite from the tip end.

7. The turbine blade of claim 6, the turbine blade further comprising a first channel extending from proximate an interface of the airfoil and the base to the third divider while between the leading edge and the first divider, the first channel further extends around the first end, between the first divider and the third divider, and further to between the first divider and the third divider to proximate the interface of the airfoil and the base.

8. The turbine blade of claim 7, the turbine blade further comprising a second channel extending from proximate the interface of the airfoil and the base to the fourth divider while between the trailing edge and the second divider, the second channel further extends around the second end, between the second divider and the forth divider, and further to between the second divider and the fourth divider to proximate the interface of the airfoil and the base.

9. The turbine blade of claim 8, wherein the first channel is partially located adjacent to the leading edge and the second channel is partially located adjacent to the trailing edge.

10. The turbine blade of claim 8, the turbine blade further comprising a third channel extending from proximate the interface of the airfoil and the base towards the tip end while between the third divider and the fourth divider, the third channel further extends between the third divider and the fourth divider to proximate the tip end.

11. The turbine blade of claim 8, the airfoil further comprising:

a fifth rib portion extending from proximate the interface of the airfoil and the base towards the tip end, the fifth rib portion located between the third divider and fourth divider; and a fifth transition portion extending from the fifth rib portion, opposite from the base, towards the trailing edge, the fifth transition portion located between the third divider and the fourth divider.

12. The turbine blade of claim 11, the turbine blade further comprising a third channel extending from proximate the interface of the airfoil and the base towards the tip end while between the third divider and the fifth rib portion, the third channel further extends between the third divider and the fifth transition portion to proximate the tip end.

13. The turbine blade of claim 12, the turbine blade further comprising a fourth channel extending from proximate the interface of the airfoil and the base towards the tip end while between the fifth rib portion and the fourth divider, the fourth channel further extends between the fifth transition portion and the fourth divider to proximate the tip end.

14. A turbine blade for use in a gas turbine engine, the turbine blade comprising:

a base including a root end, a forward face, an aft face located opposite the forward face, a first inlet located proximate to the forward face, and a second inlet located between the first inlet and the aft face;

an airfoil comprising a skin extending from the base and defining a leading edge, a trailing edge opposite the leading edge, a pressure side, and a suction side opposite the pressure side, and having a tip end opposite from the root end;

a first transition portion extending from adjacent the first inlet towards the leading edge;

a first rib portion extending from the first transition portion towards the tip end, and having a first end located opposite from the root end;

a third transition portion extending from the leading edge towards the trailing edge, located proximate to the tip end;

a third rib portion extending from the third transition portion towards the root end, located between the first rib portion and the trailing edge, the third rib portion having a third end;

a fifth rib portion extending from proximate the third end towards the tip end, the fifth rib portion located between the third rib portion and the trailing edge; and a fifth transition portion extending from the fifth rib portion radially towards the tip end and extending from the fifth rib portion circumferentially towards the trailing edge.

15. The turbine blade of claim 14, the turbine blade further comprising:

a first multi-bend heat exchange path defined by the pressure side of the skin, the suction side of the skin, the base, the first transition portion, the first rib portion, the leading edge, the third transition portion, the third rib portion, the fifth rib portion, and a fifth transition portion, the first multi-bend heat exchange path extends from the first inlet to between the first transition portion and the base located proximate to the forward face, the first multi-bend heat exchange path further extends adjacent to the leading edge and the first rib portion towards the third transition portion, the first multi-bend heat exchange path further extends around the first end to between the first rib portion and the third rib portion, the first multi-bend heat exchange path further extends around the third end to between the third rib portion and the fifth rib portion, the first multi-bend heat exchange path further extends to between the third transition portion and the fifth transition portion and towards the trailing edge.

16. The turbine blade of claim 15, the turbine blade further comprising:

a second transition portion extending from adjacent the second inlet towards the trailing edge;

a second rib portion extending from the second transition portion towards the tip end, the second rib portion located between the third rib portion and the trailing edge, the second rib portion having a second end located opposite the root end;

a fourth transition portion extending from the trailing edge towards the leading edge, located between the second end and the tip end;

a fourth rib transition portion extending from the fourth transition portion towards the root end, the fourth rib transition portion located between the third rib portion and the trailing edge;

a fourth rib portion extending from the fourth rib transition portion towards the root end, the fourth rib portion located between the third rib portion and the second rib portion, and the fourth rib portion having a fourth end located opposite from the tip end;

a second multi-bend heat exchange path defined by the pressure side of the skin, the suction side of the skin, the base, the second transition portion, the second rib portion, the leading edge, the fourth transition portion, the fourth rib transition portion, the fourth rib portion, the fifth rib portion, and the fifth transition portion, the second multi-bend heat exchange path extends from the second inlet to between the second transition portion and the base located proximate to the aft face, the second multi-bend heat exchange path further extends adjacent to the trailing edge and the second rib portion towards the fourth transition portion, the second multi-bend heat exchange path further extends around the second end to between the second rib portion and the fourth rib portion, the second multi-bend heat exchange path further extends around the fourth end to between the fourth rib portion and the fifth rib portion, the second multi-bend heat exchange path further extends between the fourth rib transition portion and the fifth transition portion towards the trailing edge.

17. The turbine blade of claim 16, wherein the turbine blade further includes a middle channel defined by the pressure side of the skin, the suction side of the skin, the first rib portion, the second rib portion, the third end, and the fourth end, wherein the first multi-bend heat exchange path and the second multi-bend heat exchange path are in flow communication with each other within the middle channel.

18. The turbine blade of claim 16, wherein the turbine blade further includes a tip end channel defined by the pressure side of the skin, the suction side of the skin, the third transition portion, the fourth transition portion, the fifth transition portion, and the trailing edge, wherein the first multi-bend heat exchange path and the second multi-bend heat exchange path are in flow communication with each other within the tip end channel.

19. The turbine blade of claim 16, wherein the tip end further includes a tip opening defined by the third transition portion, the trailing edge, the pressure side of the skin and the suction side of the skin, wherein the first multi-bend heat exchange path further extends through the tip opening.

20. The turbine blade of claim 16, wherein the trailing edge further includes a trailing edge outlet located proximate to the tip end, wherein the second multi-bend heat exchange path further extends through the trailing edge outlet.

* * * * *